United States Patent [19]

Cole

[11] Patent Number: 4,684,785

[45] Date of Patent: Aug. 4, 1987

[54] ELECTRIC BLANKETS

[75] Inventor: Graham M. Cole, Lymington, England

[73] Assignee: Dreamland Electrical Appliances PLC, Southampton, England

[21] Appl. No.: 841,539

[22] PCT Filed: Jul. 8, 1985

[86] PCT No.: PCT/GB85/00303

§ 371 Date: Feb. 28, 1986

§ 102(e) Date: Feb. 28, 1986

[87] PCT Pub. No.: WO86/00776

PCT Pub. Date: Jan. 30, 1986

[30] Foreign Application Priority Data

Jul. 10, 1984 [GB] United Kingdom ..... 8417547

[51] Int. Cl.[4] ..... H05B 3/54

[52] U.S. Cl. ..... 219/212; 219/529; 219/549; 219/505

[58] Field of Search ..... 219/200, 201, 211, 212, 219/213, 527, 528, 529, 548, 549, 504, 505

[56] References Cited

U.S. PATENT DOCUMENTS

| | | | |
|---|---|---|---|
| 2,914,645 | 11/1959 | Wallace | 219/211 |
| 4,251,718 | 2/1981 | Cole | 219/212 |
| 4,309,596 | 1/1982 | Crowley | 219/212 |
| 4,329,726 | 5/1982 | Middleman | 361/58 |
| 4,575,620 | 3/1986 | Ishii | 219/505 |

FOREIGN PATENT DOCUMENTS

| | | |
|---|---|---|
| 1502479 | 3/1978 | United Kingdom . |
| 2075777 | 11/1981 | United Kingdom . |
| 2074803 | 11/1981 | United Kingdom . |

*Primary Examiner*—E. A. Goldberg
*Assistant Examiner*—Teresa J. Walberg
*Attorney, Agent, or Firm*—Mason, Fenwick & Lawrence

[57] ABSTRACT

An electric blanket or the like includes a heating element having at least two elongate electrodes separated by a heating material that has a positive temperature coefficient of resistance and that will generate heat when a current passes through it. At least one of the electrodes is a resistive heating conductor, such as nichrome wire and is so arranged that heating current supplied to the heating element from an electrical supply will flow through both the at least one conductor and the heating material.

10 Claims, 15 Drawing Figures

ELECTRIC BLANKETS

This invention relates to electric blankets and is particularly concerned with heating elements used therein. The expression "electric blankets", as used herein, encompasses not only electrically-heated overblankets and electrically heated underblankets but also electrically heated pads, electrically heated clothing, and any other electrically heated article of a flexible sheet-like form.

Heating cables or elements used in electric blankets (or pads) conventionally comprise at least one resistive heating conductor that will generate heat when a current passes through it. (The expression "resistive heating conductor", as used herein, means a conductor whose resistance is substantially so high that, when current is passed through it, it will produce sufficient heat to warm the blanket. Such a conductor is typically formed from so-called "resistance wire", e.g. of nichrome, as distinct from low resistance wire (e.g. of copper).) It is generally, desirable that means be provided to regulate the degree of heating, in order to achieve a desired level of heating and/or to protect against excessive heating. An established and effective technique of accomplishing this is to associate with the resistive heating conductor a layer of a material (e.g. polyvinyl chloride) having a Negative Temperature Coefficient (NTC) of resistance or impedance. This material, referred to hereinafter as "the NTC material", may for example physically separate first and second conductors, one of which is a heataing conductor and the other of which is a low resistance (substantially non-resistive) sensor conductor. The impedance or resistance of the NTC material is monitored, for instance by sensing current flowing through it. At normal temperatures, the NTC material is a good insulator. At elevated temperatures, while the NTC material generally remains an insulator, a small but discernible current flows through it. This current can be monitored and used to regulate heating by regulating the current supplied to the resistive heating conductor(s). Cables of the above-outlined type are referred to hereinafter as "NTC cables".

Recently, interest has been expressed in a different kind of heating cable for electric blankets or pads, referred to hereinafter as a "PTC (Positive Temperature Coefficient) cable". Superficially, a PTC cable resembles an NTC cable in that it comprises two conductors separated by a material (in this case a PTC material) whose resistance varies with temperature. In fact, however, the difference between the two types of cable is much more radical. As explained above, in an NTC cable at least one of the conductors is a resistive heating conductor and generates sufficient heat to warm the blanket, the NTC material being an insulator that becomes less insulative as the temperature increases to enable the temperature to be monitored. In contrast, in a PTC cable, the conductors act only as electrodes to connect the PTC material to a power supply, and are therefore of a substantially non-resistive nature, and heat is generated in the PTC material (rather than in the electrodes) by current flowing through the PTC material, from the supply, via the electrodes. (Since the electrodes are, of course, not perfectly conductive, a small amount of heat will be generated in them. However, the amount of heat is very small relative to that generated in the PTC material and is insufficient in itself to provide any substantial degree of heating of the blanket). The PTC material typically comprises carbon black embedded in a polymeric matrix. Examples of PTC cables are disclosed in UK Patent Specifications Nos. GB-A-1 456 047 (Rayachem Corporation), GB-A-1 456 048 (Raychem Corporation) and GB-B-2 079 569 (Sunbeam Corporation).

In a PTC cable, the resistance of the PTC material increases, as the cable heats up from cold, thereby reducing the heating power until the temperature stabilises at a value which, for a particular cable and a particular supply voltage, will be constant. That is to say, PTC cables can be considered "self-regulating" or "self-limiting" in that they tend to stabilise at a particular temperature without the need for separate regulation circuitry. Therefore, at first sight, PTC cables appear attractive as compared to NTC cables. However, as will now be described, PTC cables are in fact subject to several disadvantages which presently detract from their attractiveness as compraed to the well estabalished, reliable and versatile NTC cables.

1. Cold Power Variation due to Bulk Resistivity Variation

A typical PTC cable is shown schematically in FIG. 1 of the accompanying drawings. The cable comprises a pair of substantially non-resistive electrodes 10, 12 (e.g. copper wires) connected to an electrical power supply. As shown, the power supply is, for example, an a c mains or network supply of 240 V (RMS) as is typically available in the UK, the electrodes 10, 12 being connected to L(240 V) and N(0 V), respectively. The electrodes 10, 12 are separated by a layer of PTC material 14, which may comprise carbon black embedded in a polymeric material (e.g. polyethylene). An approximate equivalent circuit for the cable is shown in FIG. 2 of the accompanying drawings, where the resistance of the PTC material 14 is represented by a large number of resistors or resistance elements r connected in parallel between the electrodes 10 and 12.

Assume that a cable as shown in FIGS. 1 and 2 is to be used in a pre-heating electric underblanket and that the nominal resistivity of the PTC material 14 is such that, when cold, the cable draws 400 W of power. Due to the increase in temperature of the PTC material 14 as the blanket warms up, the power input will decrease with temperature. The exact nature of the power/temperature characteristic depends on various factors such as type, size and concentration of the carbon, base polymer, degree of compounding and cross-linking radiation levels. Thus, for example, the power/temperature characteristic may typically vary as shown by curves A, A' and A" in FIG. 3 of the accompanying drawings. However, for simplicity, assume that the characteristic is as shown by curve A in FIG. 3, according to which, at tempeatures exceeding about 80° C., the resistivity of the PTC material increases by a factor of two for every 5 deg C. increase of temperature until the blanket temperature (as measured in a "standard bed") stabilises at a temperature of around 90° to 95° C., whereby the power also stabilises. The "cold power" (i.e. the power drawn when the element is switched on when the blanket is cold) and the "hot power" (i.e. the power drawn when the blanket has heated up and its temperature has stabilised) are directly related to the resistivity of the PTC material 14. Typically, a cable for underblanket use, where the use temperature is intended to stabilise at around 90° C., will have an input resistance to generate a hot power of around 90 W. That is, the hot input resistance $=V^2/R=240^2/90=640$ ohms. The cold resistance will therefore be around one quarter of this value (160 ohms), so that the cold power, i.e. the input power surge when the blanket is switched on from cold, is around $4\times90$ W, i.e. 360 W. (For convenience, this figure has been rounded-off to 400 W). If the approximate cold resistance of 160 ohms is rounded off to 150 ohms, namely one tenth of 1500 ohms, which is a standard resistor value, the behavior of the cable when cold may be approximated as shown in the equivalent circuit of FIG. 2 by considering the PTC cable as comprising, say, ten like sections each having a resistance r equal to 1500 ohms.

As indicated above, the nominal resistivity of the PTC material 14 is such that the cold resistance of the material is approximately equal to 150 ohms (r=1500 ohms) whereby the cold power is approximately equal to 400 W. However, the bulk resistivity of the PTC material (i. e. the resistivity variation between different elements produced at different times) may vary due to manufacturing tolerances in any one or more of the many factors that affect resistivity. Suppose, for example, that the resistivty is approximately halved, so that the cold resistance decreases from approximately 150 ohms (r=1500 ohms) to 68 ohms (r=680 ohms), or that the resistivity is approximately doubled so that the cold resistance increases to approximately 330 ohms (r=3300 ohms). The effect of such variations can be seen from FIG. 4 of the accompanying drawings, where a solid-line curve A corresponds to curve A in FIG. 3 and represents the power/temperature characteristic of the cable or element for the nominal resistivity (r=1500 ohms), and solid-line curves B and C represent the same characteristic for half the nominal resistivity (r=680 ohms) and twice the nominal resistivity (r=3300 ohms), respectively. As can be seen, the cold power varies proportionately with resistivity tolerances, so that the cold power varies between 200 W and 800 W. Obviosly, such a large tolerance spread in the cold power (and current) can lead to design difficulties and could, in some circumstances, be dangerous.

2. Power Variation due to Local Resistivty Variation

In the example given in 1 above, the nominal cold resistance of the PTC material 14 was 150 ohms and, in the equivalent circuit of FIG. 2, this is approximated by considering the cable as comprising ten like sections each having a resistance r equal to 1500 ohms. The initial nominal cold power of approximately 400 W would be distributed such that 40 W is dissipated in each of the ten sections, assuming that the resistance does not vary a long the length of the cable. But this assumption is not safe. There may in fact be localised resistivity variations in the PTC material of a particular element (as distinct from the bulk variations in resistivty between different elements discussed in 1. above) due to one or more of a number of factors, including carbon black content, mixing problems, extrusion tolerances etc. The nominal cold resistance of 1500 ohms of one of the ten sections might thus in fact vary from, say, 3300 ohms to 680 ohms, giving a spread of dissipation in that section of 4.9:1. This also can give rise to design problems. Also, it can give rise to the risk of localised overheating as well as varying the nominal cold power.

3. Voltage Stress Sensitivty

As acknowledged in GB-A-1 456 047 and GB-A-1 456 048 (cited above), PTC cables of the type described above tend to fail if the power supply voltage substantially exceeds 110 V, thereby rendering the cables of limited usefullness in countries where the mains or network supply voltage is greater than 110 V, for example 220 V or more. It is suggested in GB-A-1 456 047 and GB-A-1 456 048 that the problem may be due to high voltage stress resulting from the combined influence of high operational voltage and the relative contiguity of the electrodes. An atttempt to solve the problem (i.e. to make the cables in practice usable with voltages substantially exceeding 110 V) is made in GB-A-1 456 047 and GB-A-1 456 048 by resorting to the step of modifying the PTC material by locally increasing its carbon content adjacent the electrodes relative to its carbon content mid-way between the electrodes. An analogous attempt to solve the problem is made in GB-B-2 079 569 by resorting to winding at least one of the electrodes in the form of a ribbon around a core of non-conducting threads impregnated with carbon.

4. Multi-Heat Output

Assuming that the above problems could be overcome, a cable or element as shown in FIGS. 1 and 2 could be used to provide a blanket with a single heat (power) output setting. For example, as mentioned in 1. above, it could be used to provide a pre-heating underblanket having a power output of around 90 W and stabilising at an element temperature of around 90° C. (nominal). However, there is a very large demand in the electric blanket market for blankets providing user-selectable multiple heat outputs. For example, an "all-night" blanket might be expected to be able to provide at least one relatively high output for pre-heating and at least one relatively low output for when the bed is occupied. This requirement could in principle be satisfied for the cable as shown in FIG. 1 and 2 by supplying power to the cable via an energy regulator, that is to say a control device using a bimetallic strip or an elctronic switch to pulse power to the cable over a duty cycle of less than 100%. However, the provision of such an energy regulator for the cable of FIG. 1 would be technically difficult and probably expensive since the power/current drawn by the cable varies so dramatically with the cable temperature that, even if the duty cycle were as little as 20%, the blanket would look like an almost normal 80 W blanket and cable would still self-limit at a temperature of around 90° C., albeit over a longer time than if it were energised over a 100% duty cycle (i.e. without an energy regulator)

UK Patent Application Publication No.GB-A-2 118 810 (Raychem Corperation) discloses a heating element comprising two elongate electrodes or conductors seperated by a PTC heating material. One end of one electrode is connected directly to one pole of a power supply. The remote end of the other electrode is connected to the other pole of the power supply by a third conductor. The resistance of the conductors, which are 18 AWG tin-coated copper standard wire electrodes, is as low as is consistent with other factors such as weight, flexibilty and cost. The heating elements described are evidently not intended for use in electric blankets or the like. Instead, they appear to be intended for use in applications in which very long elements of low power output are required. Due to this peculiar application, the small amount of heating power produced by current flowing through the three low-resistance copper conductors (which amount of power would be in sufficient in practice to heat an electric blanket) is comparable with the small amount of heating power produced by current flowing through the PTC heating material.

The elements described in GB-A-2 118 810 are said to reduce power inrush. Presumably, this means that the cold power for a given hot power is reduced to compare to the known circuit shown in FIG. 1 of the present specification. However, there is no indication that the heating elements of GB-A-2 118 810 solve problems associated with local or bulk resistivity variations of the PTC material as discussed under 1. and 2. above.

It is indicated in GB-A-2 118 810 that the potential drop across the electrodes is reduced as compared to the supply voltage, in particular when the third conductor has substantial impendance. FIGS. are quoted which, in the presence of the third conductor of the same length as the electrodes, indicate that the voltage across the electrodes may be reduced to less than half the supply voltage. The third conductor would be impratical (and unnecessary) in the case of a heating element for an electric blanket. Presumably, if (contrary to the teaching of GB-A-2 118 810) the third conductor were omitted, the voltage across the electrodes would be reduced to a markedly smaller degree. In any event, the present applicants believe that the figures quoted for the reduction of the voltage across the electrodes would apply only to the situation before the PTC material self-regulates: when this occurs, and the PTC material resistance increases, the voltage drop along the conductors decreases and the voltage dropped across the electrodes rises towards the supply voltage value.

There is no indication in GB-A-2 118 810 as to how multi-heat outputs could be provided.

According to the present invention there is provided an electric blanket including a heating element comprising at least two elongate electrodes separated by a heating material that has a positive temperature coefficient of resistance and that will generate heat when a current passes through it, characterised in that at leat one of the electrodes is a resistive heating conductor and is so arranged that heating current supplied to the heating element will flow through both said at least one conductor and the heating maaterial.

The fact that the heating current passes through at least one resistive heating conductor as well as the resistance of the PTC heating material can enable a reduction in the above-described effects of any localised or bulk variation in the nominal resistivity of the PTC heating material.

Embodiments of the invention described below are so constructed that the full supply voltage does not appear across the PTC heating material, so minimising the effect of the above-discussed problem associated with voltage stress sensitivity. More specifically, the maximum voltage across the PTC material at any position along its length, whether the heating element is cold or hot (at its nominal working temperature), does not substantially exceed half the supply voltage. According to a first such embodiment, the element is so arranged that heating current flows through said at least one electrode and not the other of the at least two electrodes. According to a second such embodiment, one end of said at least one electrode is connected to an end of the other of said at least two electrodes and heating current flows through both the at least two electrodes in series.

Further, electric blankets embodying the invention can readily be so constructed as to provide multi-heat outputs in a simple and economical manner. For example, a half-wave rectifier means may be connectable in series with the at least one electrode so as to half-wave rectify the heating current to thus reduce the heating current. Additionally or alternatively, switch means may be provided to enable the element to be switched between different configurations (for example those of the first and second embodiments mentioned above) each providing different outputs.

A heating element embodying the invention may, as in the prior art, comprise a unitaray cable structure comprising at least two electrodes and the PTC heating material. It is, however, within the scope of the invention for the heating element to comprise an assembly or arrangement of separate cables, for example at least two cables that are twisted together and each comprise at least one electrode.

The invention will now be further described, by way of illustrative and non-limiting example, with reference to the accompanying drawings, in which.

The known heating element represented in FIGS. 1 and 2 and the characteristics thereof shown in FIGS. 3 and 4 have been described hereinabove.

Figure 5:
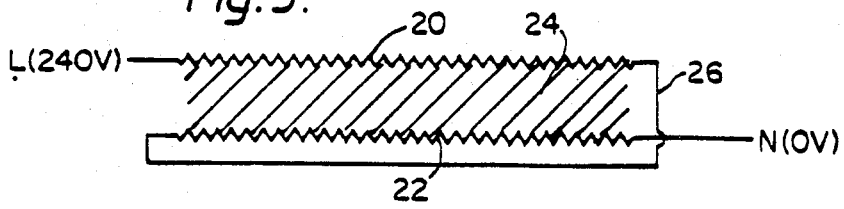
FIG. 5 is a schematic circuit diagram of a first PTC heating element for use in an electric blanket embodying the present invention.

FIG. 5 shows a first heating element for use in an electric blanket embodying the invention, the element being laid out in the electric blanket in a manner which is not shown but which is well known to those skilled in the art. In like manner to the heating element of FIG. 1, that of FIG. 5 comprises a pair of electrodes 20, 22 connected to a 240 V (RMS) a c mains or network supply, the electrodes being separated by a layer of PTC material 24 which may, for example, comprise carbon black embedded in a polymeric material (e.g. plyethylene).

Figure 1:
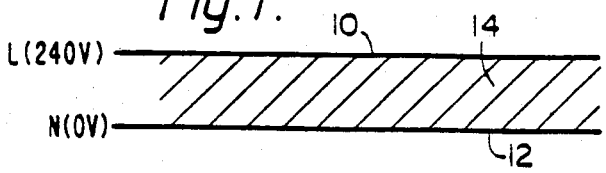
Fig. 1. (PRIOR ART)
FIG. 1 is a schematic circuit diagram of a known PTC heating cable or element.

The element of FIG. 5 differs from that of FIG. 1 in two respects. Firstly, the electrodes 20 and 22 are of a resistive material (e.g. resistance wire such as nichrome wire) so that they comprise resistive heating conductors whereby current flowing through them dissipates power and leads to the generation of heat additional to that generated by heating current flowing through the PTC material via the electrodes. Secondly, the end of the electrode 20 at one end of the element is connected by an external link 26 to the end of the electrode 22 at the other end of the element, so that the electrodes are connected in series, and the series combination of the electrodes is connected between the poles of the 240 V (RMS) mains supply in the manner shown. As is known to those skilled in the art, the two ends of a heating element of an electric blanket are conventionally both brought back to a common connection position. Consequently, contrary to what might appear to be the case from the rather schematic drawings, the link 26 is in fact short. Also, the respective poles of the supply are connected directly to the respective ends of the electrodes 20 and 22 at the common connection position.

The heating element of FIG. 5 generates heat in two way. Firstly, heat is generated by heating current flowing through the electrodes 20 and 22, by virtue of their resistive nature. Secondly, as in the known circuit of FIG. 1, the electrodes 20 and 22 enable heating current to flow between them through the PTC material 24 so that the material 24 also generates heat. As in the known element of FIG. 1, heating of the PTC material 24 (by both sources of heating) increases the resistance of the material 24 until the element stabilises at a particular temperature. That is, the element of FIG. 5 displays a self-regulating action. However, as will be explained below, it does so in a manner which at least alleviates some of the above-mentioned disadvantages associated with the known circuit of FIG. 1.

Figure 6:
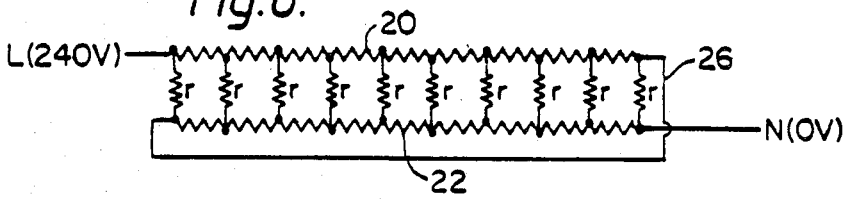
FIG. 6 shows an approximate equivalent circuit for the heating element shown in FIG. 5.

It is extremely difficult to calculate the precise electrical behaviour of the element of FIG. 5, in view of the distributed nature of the resistance of the PTC material 24. The task is made a little simpler by the equivalent circuit shown in FIG. 6. (It is acknowledged that this equivalent circuit is a somewhat crude approximation to the actual element. Nonetheless, it is believed to represent the actual circuit to a sufficient degree of accuracy for present purposes). In like manner to the equivalent circuit of FIG. 2, the equivalent circuit of FIG. 6 represents the resistance of the PTC material (which is 150 ohms when cold) as, say, 10 resistors r (each of 1500 ohms when the blanket is cold) spaced apart along the length of and connected between the electrodes 20 and 22. Each of the electrodes 20 and 22 has a resistance of 1000 ohms, so each adjacent pair of the resistors r is joined at each end by a length of electrode having a resistance of 100 ohms.

Even with the above simplifications, the electrical behaviour of the element is difficult to calculate. Accordingly, a model of the element was made in the form shown in FIG. 6 and the various electrical parameters thereof were measured. The cold power (i.e. the power when r=1500 ohms) was found to be 100 W. The voltage drops across the individual resistors r were measured for various values of r. The results obtained are shown graphically in FIG. 7, which is discussed later on.

The ways in which the circuit of FIG. 5 can alleviate the above-discussed disadvantages of the known circuit of FIG. 1 will now be explained.

Figure 4:
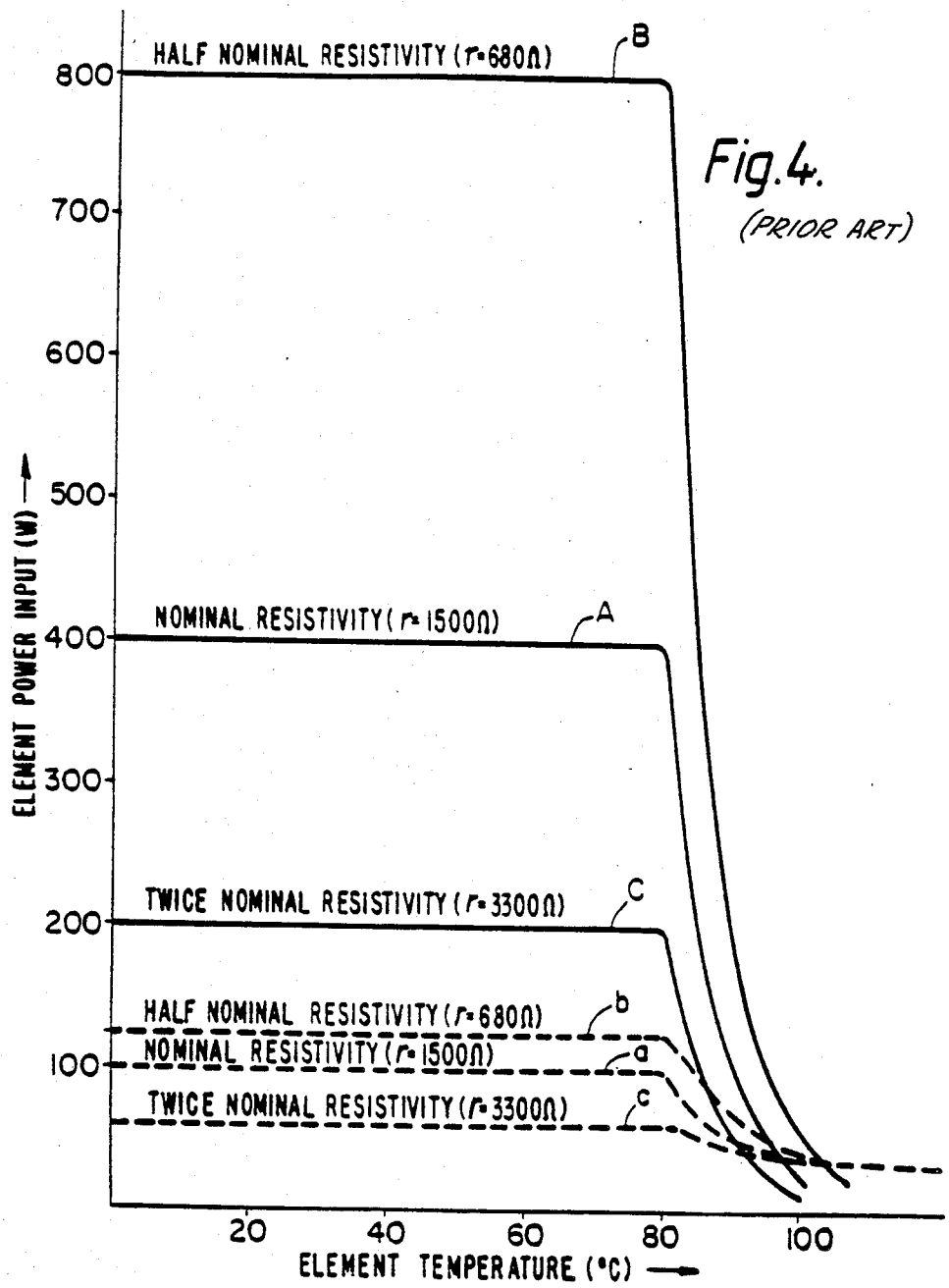
Fig. 4. (PRIOR ART)
FIG. 4 is a graphical representation corresponding to FIG. 3, but showing the effects of variations of resistivity of PTC heating material used in constructing the cable or element.

Considering first the question of cold power variation due to bulk resistivity variation of the PTC material, if will be recalled that FIG. 4 shows solid-line curves A, B and C that represent the power/temperature characteristic of the known element of FIG. 1 where the PTC material is of nominal resistivity (r=1500 ohms), half nominal resistivity (r=680 ohms) and twice nominal resistivity (r=3300 ohms), respectively. Dotted-line curves a, b and c also shown in FIG. 4 represent like characteristics for the element of FIG. 5 based on measurements made on the equivalent circuit of FIG. 6. That is to say, assuming PTC material of the same nominal resistivity as used in the element of FIG. 1 is employed, and that the resistivity starts to increase at a around 80° C. by a factor of two for every 5 deg C. increase in ambient temperature, measurements made on the equivalent circuit of FIG. 6 give an input characteristic for nominal resistivity (r=1500 ohms) as shown by curve a in FIG. 4. Curves b and c represent the characteristics obtained based on measurements where the resistors r are changed to 680 ohms (simulating a change in resistivity to approximately half the nominal value) an where the resistors are changed to 3300 ohms (simulating a change in resistivity to approximately twice the nominal value). The curves a, b and c clearly show the improvement as regards the cold power or input power surge between the known element of FIG. 1 and the element of FIG. 5. In particular, the spread of cold power for the same predetermined resistivity spread for the same PTC material is reduced from (800 W−200W)=600 W, equal to 1.5 times the nominal value of 400 W, to (125 W−60 W)=65 W, equal to 0.65 times the nominal value of 100 W. That is to say, the spread in cold power variation for the same resistivity variation of the same PTC material is reduced by considerably more than half. This is, in substance, achieved soley by replacing the low-resistance conductors of the known element by resistance wires (1000 ohms) and connecting the resistance wires in series as shown in FIG. 5. The reduction in cold power spread can considerably assist the designer.

It will be noted, incidentally, from FIG. 4 that the curves a, b and c will blend together should the temperature reach a value in the region of 100° C. This is due to the fact that should this temperature be achieved, which would not normally be the case, so little heating current passes through the PTC material that the power drawn is governed largely only by the resistance of the resistive heating conductor electrodes 20, 22.

Figure 2:
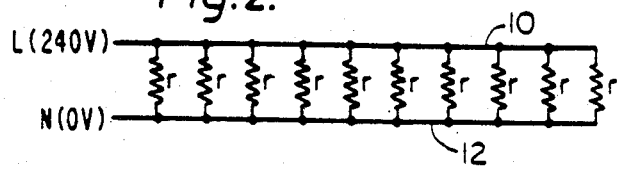
Fig. 2. (PRIOR ART)
FIG. 2 shows an approximate equivalent circuit for the cable or element shown in FIG. 1.
Figure 3:
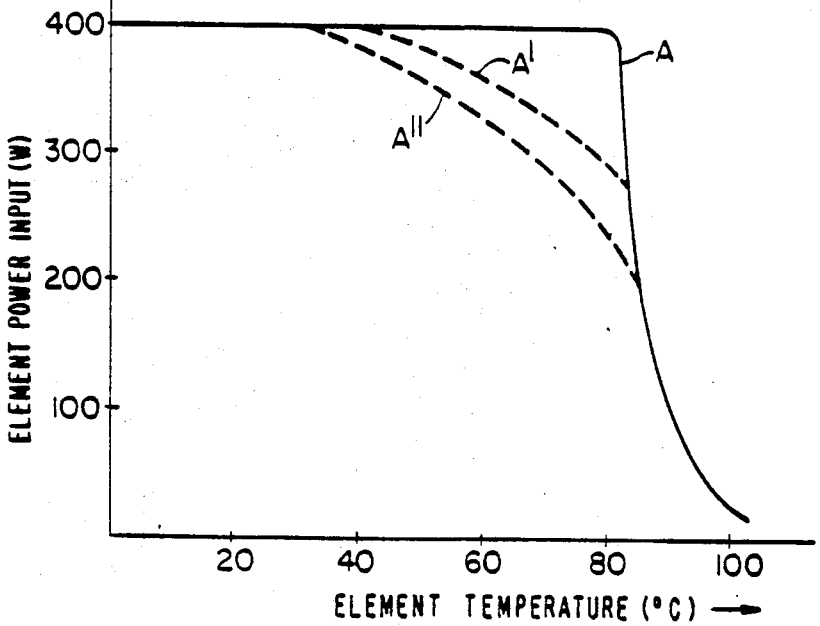
Fig. 3. (PRIOR ART)
FIG. 3 is a graphical representation of the power input/temperature characteristic for the PTC heating cable or element of FIGS. 1 and 2.

Considering now the queston of localised PTC material cold resistivity variation, it was indicated above that the nominal cold resistance of 1500 ohms of one of the ten sections of the known element of FIGS. 1 and 2 might in fact vary between, say, 3300 ohms and 680 ohms, giving a spread in dissipation in that section of 4.9:1. Measurements on the equivalent circuit of FIG. 6 have shown that a similar change in resistance will lead to a much less dramatic change in power dissipation. For instance, varying the value of one of the resistors r from 3300 ohms to 680 ohms produces a spread of dissipation in that section of only 2.7:1 (as compared to 4.9:1).

Figure 7:
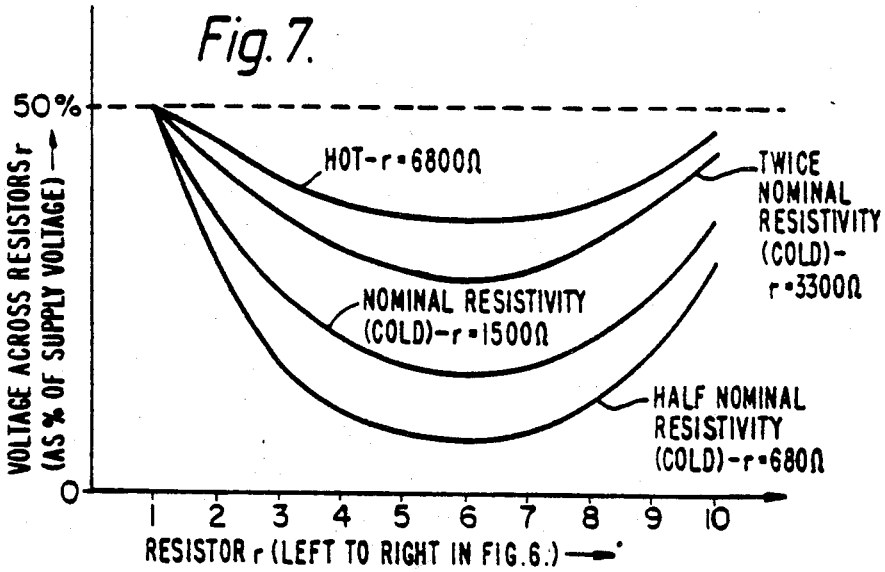
FIG. 7 is a graph showing voltages measured across resistors r in the equivalent circuit of FIG. 6.

As regards the question of voltages stress sensitivity, reference should be made to FIG. 7 which, as indicated above, shows the voltages measured across the ten resistors r of the equivalent circuit of FIG. 6, as a percentage of the supply voltage, for various values of r. As can be seen, the maximum voltage drop across the PTC material, namely the voltage across the left-hand resistor r in FIG. 6, is half of the supply voltage when r=1500 ohms (nominal resistivity with the element cold), r=680 ohms (half nominal resistivity with the element cold) and r=3300 ohms (twice nominal resistivity with the element cold). The same applies when the element is hot, as similated by measurements performed with r equal to 6800 ohms, corresponding to a hot resistance of the PTC material of 680 ohms. At other positions, the voltage drop is less than 50% of the supply voltage.

Figure 8:
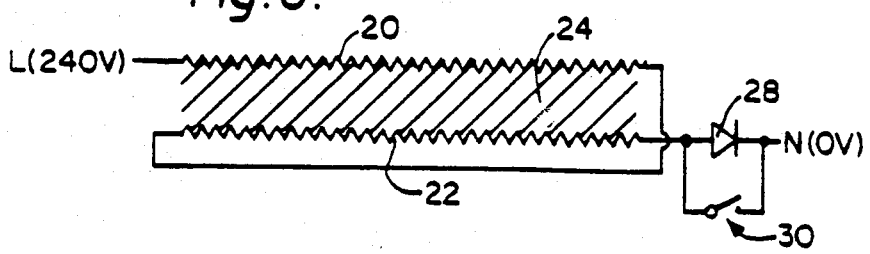
FIG. 8 shows a modification that can be made to the heating element of FIGS. 5 and 6.

Finally, as regards multiple heat outputs, a first technique of providing same (others are described below) comprises modifying the element of FIG. 6, for example as shown in FIG. 8, by connecting a half-wave rectifying means such as a diode 28 and a bypass switch 30 in series with the electrodes 20 and 22. When the switch 30 is closed, the heating element operates as described above. When the switch 30 is opened, the heating current is half-wave rectified whereby the cold power is reduced by 50%. Surprisingly, in view of the self-regulating nature of the element, the hot power also is reduced. How this is accomplished will now be decribed.

Figure 9:
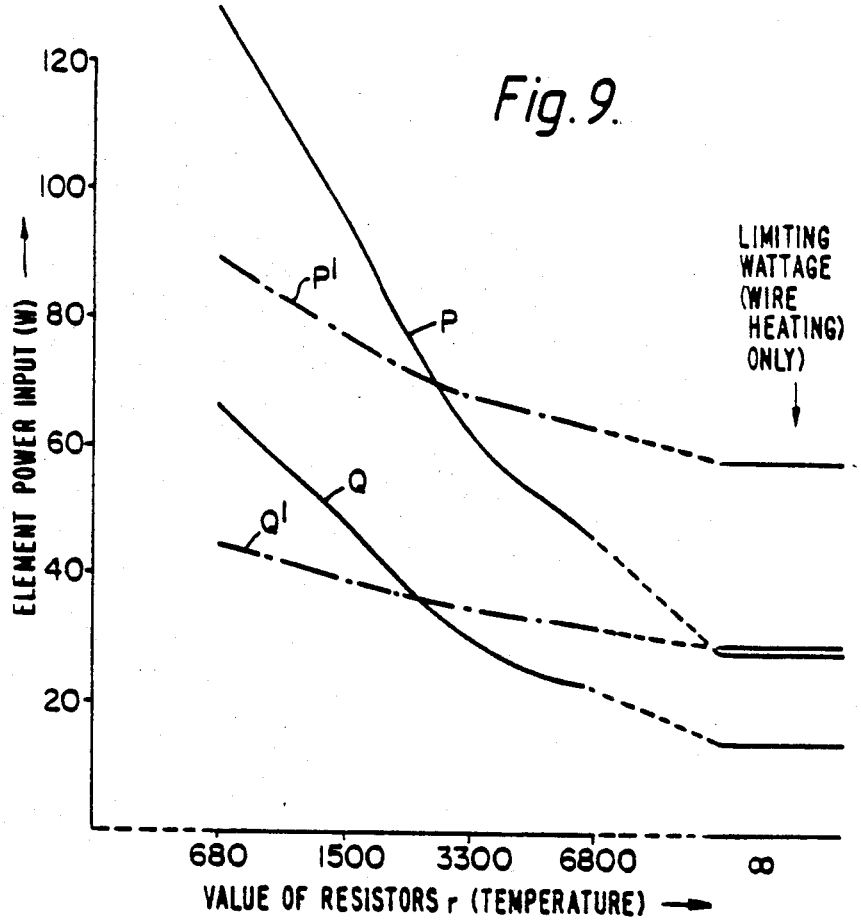
FIG. 9 is a graph showing the heating element power input against various values of the resistors r in an equivalent circuit (corresponding to that of FIG. 6) for the heating element of FIG. 8.

FIG. 9 is a graph plotted from measurements taken on an equivalent circuit for the element of FIG. 8, corresponding to that of FIG. 6, with the diode 28 bypassed by the switch 30 (curve P) and with the diode 28 in circuit (curve Q). The graph plots power for different values of the resistors r, namely 680 ohms, 1500 ohms, 3300 ohms, 6800 ohms and infinity (i.e. with the resistors r removed or open circuited). As will by now be appreciated, since the resistors r represent the resistivity of the PTC material, which increases with temperature, the horizontal axis or abscissa of FIG. 9 corresponds to the element temperature.

It might at first be considered that the diode 28 would not act effectively to produce a reduced heat output. However, FIG. 9 demonstrates that this is not the case. What appears to happen is this. The element warms up and if, by thermal lagging, the temperature is permitted to reach the temperature (e.g. about 80° C.) at which the resistivity starts to change dramatically, the input power will reduce accordingly. However, based on the measurements made on the equivalent circuit, it is believed that the element will more probably only achieve a temperature of no more than about 40° to 50° C., thereby giving a definite lower temperature setting and, correspondingly, a lower heat output.

Figure 10:
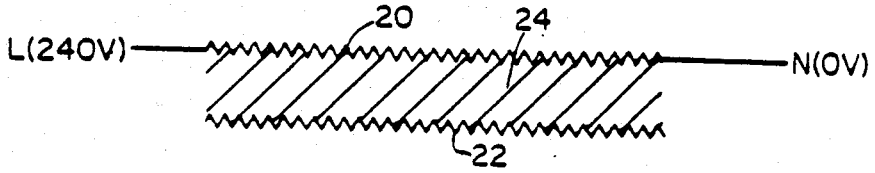
FIG. 10 is a schematic circuit diagram of a second PTC heating element for use in an electric blanket embodying the present invention.
Figure 11:
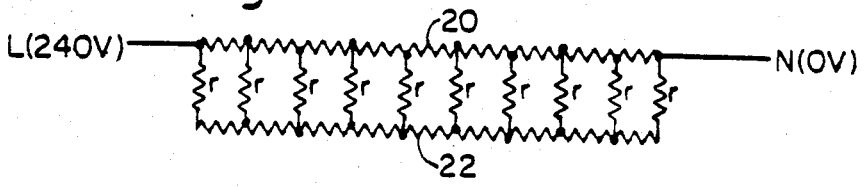
FIG. 11 shows an apaproximate equivalent circuit for the heating element shown in FIG. 10.

FIG. 10 shows another heating element embodying the invention, an equivalent circuit therefor (similar to those of FIG. 2 and 6) being shown in FIG. 11. This element is similar to that of FIGS. 5 and 6, except that the element 20 is connected between the poles of the a c supply and little or no heating current therefore flows in the electrode 22. (As in the embodiment of FIG. 5, the two ends of the element are brought back to a common connection portion, as is conventional in electric blankets, so that the respective poles of the supply are connected directly to respective ends of the electrode 20 at the common connection position). Heating is effected by the passage of current through the electrode 20 and by the distributed flow of current through the PTC material 24 in parallel with the current flowing through the electrode 20. Once again, the heating current flowing through the PTC material 24 reduces as its temperature increases until self-regulation or self-limiting occurs at a particular temperature.

Measurements taken on the equivalent circuit of FIG. 11 indicate that, once again, the effect of large variations or spreads in the localised or bulk resistivity of the PTC material are suppressed in the heating element of FIG. 10 as compared to the known heating element of FIG. 1.

The variation of power with temperature in the case of the heating element of FIG. 10 is represented by a curve P′ drawn in FIG. 9, the curve P′ being derived by measurements taken on the equivalent circuit of FIG. 11 similar to those from which the curve P was obtained by measurements taken on the equivalent circuit of FIG. 6.

Figure 12:
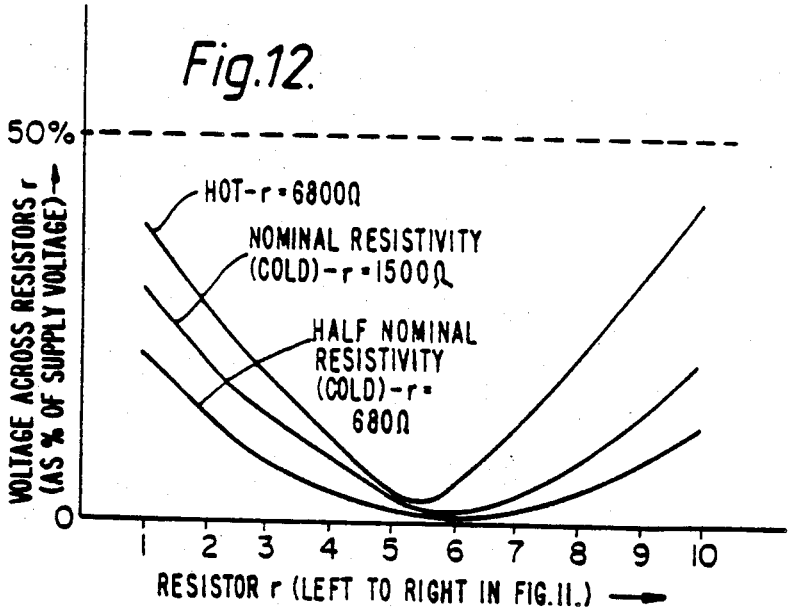
FIG. 12 is a graph showing voltages measured across resistors r in the equivalent circuit of FIG. 11.

With regard to voltage stress sensitivity, reference should be made to FIG. 12 which, inlike manner to FIG. 7, shows the voltages measured across the ten resistors r of the equivalent circuit of FIG. 11, as a percentage of the supply voltage, for various values of r. As can be seen, the maximum voltage drop across the PTC material 24, whether the element is hot or cold, is less than half the supply voltage.

Figure 13:
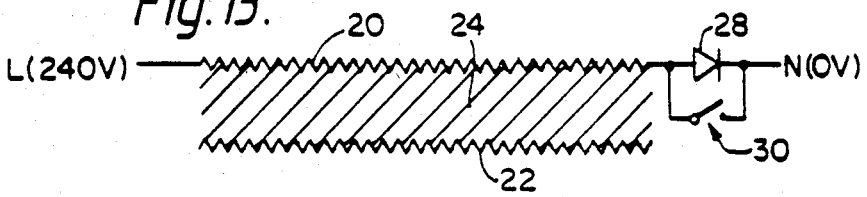
FIGS. 13 and 14 show modifications that can be made to the heating element of FIGS. 10 and 11.

A multiple heat output can be provided for the heating element of FIG. 10, in the same way as in FIG. 8, by provision of the diode 28 and switch 30: see FIG. 13. The cold power could in this way be reduced from 80 W to 40 W and the hot power also is reduced in like manner to FIG. 8. See, in this connection, curves P′ and Q′ in FIG. 9, which represent the variation of power with temperature for the heating element of FIG. 13 with the switch 30 closed and opened, respectively. The curves P′ and Q′ correspond to the curves P and Q and were obtained, in like manner, by measurements on an equivalent circuit for the heating element of FIG. 13.

Additionally or alternatively, a multiple heat output could be obtained by providing electrodes 20 and 22 of different resistances (and therefore power outputs) and including switch means enabling either of the electrodes to be switched into the position occupied by the electrode 20 in FIG. 10.

Figure 14:
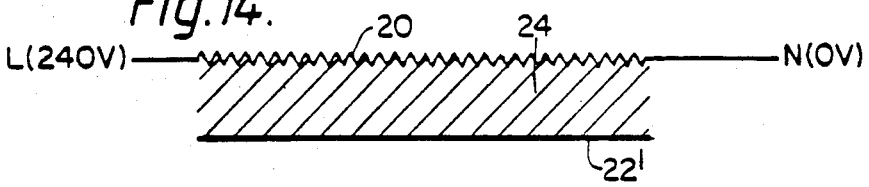

As indicated above, in the element of FIGS. 10 and 11 (and in the modification of FIG. 13) the element 22 carries little or no heating current. Therefore, as shown in FIG. 14, it could be replaced by a non-resistive electrode 22′, e.g. a copper wire.

Figure 15:
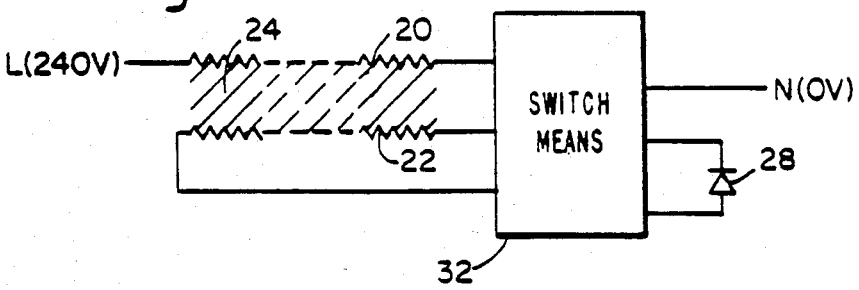
FIG. 15 is a schematic circuit diagram of a third PTC heating element for use in an electric blanket embodying the present invention.

FIG. 15 shows a particularly preferred embodiment of the invention. This embodiment comprises electrodes 20 and 22, PTC material 24 and a diode 28, all as described above, together with a switch means 32 which enables the element to be switched to either of the configurations shown in FIG. 8 (diode 28 in circuit or shunted) or either of the configurations shown in FIG. 13 (diode 28 in circuit or shunted). In this way, four different cold power settings (100 W, 50 W, 80 W and 40 W) and, therefore, four different heat output settings can be selected simply by operation of the switch means 32. (Alternatively, if a lesser number of settings is sufficient, the switch means 32 could be of a simpler form and/or the diode 28 could be omitted so that a lesser number of the above configurations could be selected). Also, a further heat setting or settings could be obtained if, as described above, the electrodes 20, 22 are of different resistances and the switch means 32 is capable of interchanging them when in the configuration of FIG. 10 or FIG. 13.

The various elements described above can be constructed in a variety of ways. For instance, the electrodes 20 and 22 and the PTC material 24 can comprise a unitary cable which is laid out in a manner known per se in an electric blanket or the like. The cable might comprise an inner core around which wire forming one electrode is wound or wrapped, a layer of PTC material surrounding the one electrode, and wire forming another electrode wound or wrapped around the PTC material. The cable might instead comprise two or more electrodes (e.g. wires wrapped around respective cores) arranged side-by-side with PTC material between them to form a parallel twin construction cable. However, a variety of other constructions could be employed. The element could for example comprise two or more electrodes each sheathed with PTC material to form a wire or cable, the wires or cables being twisted together whereby the PTC material between the electrodes is formed jointly by the contiguous sheaths.

I claim:

1. An electric blanket including a heating element comprising at least two elongate electrodes separated by a heating material that has a positive temperature coefficient of resistance and that will generate heat when a current passes through it, wherein at least one of the electrodes is a resistive heating conductor and the electrodes and the heating material are so arranged that heating current supplied to the heating element will flow through both the heating material and through a current path that comprises said at least one of the electrodes and that excludes the resistance of the heating material.

2. An electric blanket according to claim 1, wherein the heating element is so arranged that heating current will flow through said at least one electrode and will not flow through the other of said at least two electrodes, said at least one electrode constituting said current path.

3. An electric blanket according to claim 2, wherein both of said at least two electrodes are resistive heating conductors, the resistances of the two conductors differ, and switch means is provided which enables the selection of either of two configurations in each of which a respective one of the two electrodes is said at least one conductor through which heating current will flow.

4. An electric blanket according to claim 1, wherein bothof the at least two electrodes are resistive heating conductors, one end of said at least one electrode is connected to an end of the other of the at least two electrodes, and the at least two electrodes are so arranged that heating current supplied to the heating element will flow through both the at least two electrodes in series, said series-connected at least two electrodes constituting said current path.

5. An electric blanket according to claim 1, wherein both of the at least two electrodes are resistive heating conductors, and which include switch means capable of enabling selection of either of the following circuit configurations:

(i) the heating element is so arranged that heating current will flow through said at least one electrode and will not flow through the other of said at least two electrodes; and (ii) one end of said at least one of said at least one elctrode is connected to an end of the other of the at least two electrodes, and the at least two electrodes are so arranged that heating current supplied to the hearing element will flow through both the at least two electrodes in series.

6. An electric blanket according to claim 5, which includes half-wave rectifier means and wherein the switch means is capable of enabling selection of any one of circuit configurations (i) and (ii) and the following two circuit configurations:

(iii) as configuration (i), but with half-wave rectifier means connected in series with said at least one electrode and (iv) as configuration (ii), but with half-wave rectifier means connected in series with the at least two electrodes

7. An electric blanket according to claim 6, wherein the resistances of the two electrodes differ, and wherein the switch means is capable of enabling selection of any one circuit configurations (i) to (iv) and the following circuit configuration:

(v) as configuration (i), but with the dispositions of the electrodes reversed.

8. An electric blanket according to claim 1, including half-wave rectifier means and switch means enabling the rectifier means selctively to be connected in series with the electrodes or electrodes through which heating current will flow.

9. An electric blanket according to claim 1, wherein all four ends of the at least two elongate electrodes are located at a common position whereby a pair of poles of a power supply can be connected directly to two of said ends.

10. An electric blanket according to claim 1, wherein said at least one electrode is of nichrome wire.

* * * * *